United States Patent [19]

Wuest

[11] Patent Number: 4,461,125

[45] Date of Patent: Jul. 24, 1984

[54] CONTROL CIRCUIT FOR AN APPARATUS FOR ADJUSTING AND DRESSING A GRINDING WHEEL

[75] Inventor: Ulrich Wuest, Adliswil, Switzerland

[73] Assignee: Maag Gear-Wheel & Machine Company Limited, Zürich, Switzerland

[21] Appl. No.: 284,971

[22] Filed: Jul. 20, 1981

[30] Foreign Application Priority Data

Jul. 31, 1980 [CH] Switzerland ..... 5835/80

[51] Int. Cl.[3] ..... B24B 53/00

[52] U.S. Cl. ..... 51/165.88; 51/165.77; 125/11 R

[58] Field of Search ..... 51/165.77, 165.87, 165.88; 125/11 R

[56] References Cited

U.S. PATENT DOCUMENTS

| | | | |
|---|---|---|---|
| 3,214,965 | 11/1965 | Wellborn | 125/11 R |
| 3,404,670 | 10/1968 | Gluchowicz | 125/11 R |
| 3,457,678 | 7/1969 | Temple | 125/11 R |
| 3,500,811 | 3/1970 | Perkins | 125/11 R |
| 3,691,698 | 9/1972 | Schaller | 51/135 R |
| 4,213,277 | 7/1980 | Fivian | 51/165.88 |
| 4,295,301 | 10/1979 | Barth | 51/165.88 |

FOREIGN PATENT DOCUMENTS

| | | | |
|---|---|---|---|
| 481021 | 2/1938 | United Kingdom | 51/165.88 |
| 544542 | 2/1977 | U.S.S.R. | 51/165.87 |

*Primary Examiner*—Harold D. Whitehead
*Attorney, Agent, or Firm*—Werner W. Kleeman

[57] ABSTRACT

A control circuit contains, instead of the otherwise conventional feeler or scanner contact, a displacement pick-up or displacement path transmitter which delivers pulsating signals representative of the irregularities of the scanned grinding wheel. The effective value of such pulsating signals, measured over a scanning or feeling interval, is dependent upon the wear of the grinding wheel or constitutes a measure of the compensating adjustments or repositioning displacements of the grinding wheel. The evaluation of the output signals of the displacement path transmitter or pick-up delivers data concerning the properties of the surface of the grinding wheel, the time during which there is to be undertaken a compensation feed of the grinding wheel, the frequency of the compensating feed and the degree of the compensating or adjustment feeds of the grinding wheel, and specifically, for the positional readjustment and dressing of the grinding wheel both in axial and also in radial direction.

12 Claims, 9 Drawing Figures

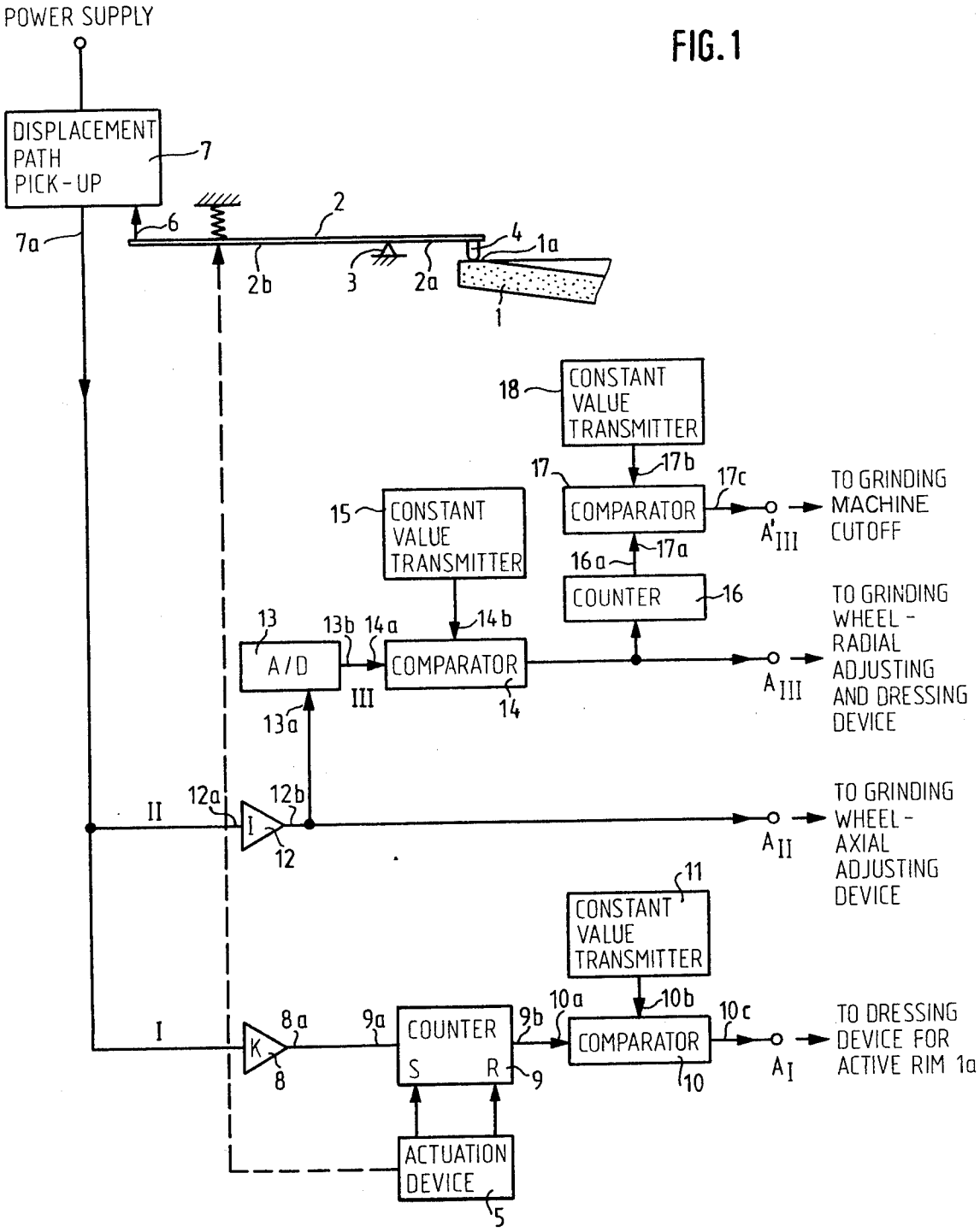
FIG. 1
POWER SUPPLY
DISPLACEMENT PATH PICK-UP
7
7a
6
2
2b
3
2a
4
1a
1
18
CONSTANT VALUE TRANSMITTER
17
17b
COMPARATOR
17c
TO GRINDING MACHINE CUTOFF
A'III
15
CONSTANT VALUE TRANSMITTER
16a
17a
COUNTER
16
13
13b
14a
14b
A/D
COMPARATOR
A III
TO GRINDING WHEEL - RADIAL ADJUSTING AND DRESSING DEVICE
III
13a
14
II
12a
12b
I
12
A II
TO GRINDING WHEEL - AXIAL ADJUSTING DEVICE
11
CONSTANT VALUE TRANSMITTER
10a
10b
10c
I
8a
9a
COUNTER
9b
COMPARATOR
TO DRESSING DEVICE FOR ACTIVE RIM 1a
K
8
S
R
9
10
A I
ACTUATION DEVICE
5

CONTROL CIRCUIT FOR AN APPARATUS FOR ADJUSTING AND DRESSING A GRINDING WHEEL

BACKGROUND OF THE INVENTION

The present invention relates to a new and improved construction of control circuit for an apparatus for adjusting and dressing a dished or plate-shaped grinding wheel, and which is of the type containing a feeler or sensor which can be periodically brought into contact at one feeler end with the grinding wheel, wherein the other feeler end acts by means of an operative connection upon a control circuit.

According to a prior art apparatus for dressing a grinding wheel at a gear wheel-grinding machine, for instance as disclosed in the commonly assigned U.S. Pat. No. 4,213,277, granted July 22, 1980 and the corresponding German patent publication No. 2,724,843, published Nov. 9, 1978, for the periodic dressing of a planar ring-shaped portion or active rim of a dished or plate-shaped grinding wheel which can be axially repositioned there is controlled the position of the active rim of the grinding wheel and such grinding wheel is repositioned such that the active rim or ring-shaped portion remains positioned at the same site independent of its wear. This active rim is dressed one respective time within a preselected dressing interval by means of a likewise axially adjustable dressing tool. For this purpose there is provided a control circuit equipped with a feeler contact attached to a feeler or sensor. The feeler is intermittently applied to the active rim of the grinding wheel and, as soon as the feeler contact is closed in response to a certain wear of the active rim, the control circuit delivers a command for the readjustment or compensating feed of the grinding wheel This compensating feed is accomplished in each instance through the spacing of one tooth of a ratchet wheel, by means of which there can be positionally adjusted the grinding wheel spindle. If within a preselected dressing interval there is not attained a predetermined number of compensating feeds, then this is interpreted as an indication that the surface of the grinding wheel is smudged or clogged, i.e. clogging of its pores by grinding dust, oil and so forth, and that the grinding wheel has not performed its proper grinding operation within a dressing interval. Thus, in this case the control circuit delivers a further command, by means of which a dressing tool is advanced by one tooth of a further ratchet wheel, and thereafter the dressing tool is pivoted over the active rim of the grinding wheel for dressing such grinding wheel.

With this state-of-the-art equipment the scanning of the grinding wheel is only intended for accomplishment of the compensating feed or readjustment of the grinding wheel since the dressing operation always remains constant and only then is initiated if, within a dressing interval, there has not been attained the preselected number of grinding wheel-compensating feeds or readjustments. What can be considered to be capable of improvement with this equipment operation is that the feeling or scanning operation delivers no information or data regarding the quality of the grinding wheel, i.e. it is not possible to draw any conclusions regarding the appearance of its grinding surface. Additionally, during the dressing operation always the same amount of material is removed from the grinding wheel without really knowing whether such material removal is even absolutely needed. Moreover, since the feeler contact only delivers a Yes/No-information, i.e. whether the grinding wheel is to be readjusted or not, it is not possible to determine to what extent the grinding wheel spindle is to be fed or readjusted in each case. It is for this reason that with such prior art equipment the grinding wheel spindle is simply always positionally adjusted through one tooth of the ratchet wheel. Whether or not such compensating feed is adequate or too great only can be determined during the next feeling or scanning interval.

When the active rim of a grinding wheel, following a number of compensating feeds, has reached a certain axial minimum dimension by virtue of the dressing work, then the danger exists that the grinding wheel tends to bend because of the grinding pressure which is exerted, and thus, produces unsatisfactory grinding results. Therefore, it is necessary to adjust the grinding wheel in radial direction, so that its jacket or outer surface can be dressed by a further dressing device. The prior art equipment furnishes no data as to the point in time when such radial adjustment of the grinding wheel, and thus, dressing of its outer or jacket surface is to take place.

Moreover, it is generally possible in the case of grinding machines that the operator manually readjusts the grinding wheel spindle. At a grinding machine equipped with a conventional apparatus known in this technology, should the grinding wheel spindle be readjusted manually to too great an extent, then the dressing tool will unnecessarily remove too much material from the grinding wheel. This reduces the service life of the grinding wheel. The same drawback occurs when the grinding wheel, with automatic compensating feed or advance, is too frequently positionally readjusted during a dressing interval, because then the grinding wheel is dressed too often and then again must be readjusted through one ratchet wheel tooth.

SUMMARY OF THE INVENTION

Therefore, with the foregoing in mind it is a primary object of the present invention to provide a control circuit for an apparatus for adjusting and dressing a grinding wheel which is not afflicted with the aforementioned drawbacks and limitations of the prior art heretofore discussed.

Another and more specific object of the present invention aims at providing a control circuit for an apparatus for the adjustment and dressing of a grinding wheel, which control circuit is constructed such that it indicates the actual degree of wear of the grinding wheel and its surface properties and only initiates a compensating feed or adjustment of the grinding wheel and/or a grinding wheel dressing operation when it is absolutely necessary to do so, and then only to the extent needed.

Now in order to implement these and still further objects of the invention, which will become more readily apparent as the description proceeds, the control circuit of the present development is manifested by the features that the feeler acts by means of the operative connection upon a displacement path transmitter or pick-up, the output of which is connected with at least one circuit branch for the evaluation and processing of the displacement path transmitter-output signal.

While the state-of-the-art control circuit equipped with a feeler contact is only capable of indicating whether or not the grinding wheel has been worn or not worn, and thus must be positionally readjusted or should not be positionally readjusted, the control circuit of the invention delivers during the scanning operation appreciably more information because with the invention there is employed, instead of a feeler contact, a displacement path transmitter or pick-up. By means of this increased quantity of data it is possible to draw certain conclusions concerning the quality of the surface of the grinding wheel.

According to a further aspect of the invention, the displacement path transmitter or displacement pick-up can be constructed as a capacitive, inductive or photoelectric pick-up and delivers pulsating signals in accordance with the movements of the feeler caused by irregularities in the grinding wheel. From the peak number and effective value of such pulsating signals there can be obtained the necessary information for the compensating feed and dressing of the grinding wheel with the aid of simple pulse-shaping and integrating circuits The control circuit can comprise a first circuit branch and there is connected in series between the output of the displacement path transmitter and a first output terminal connected with a dressing device for the active rim of the grinding wheel a comparator for forming a digital value from each edge or flank of the output signal of the displacement path transmitter resulting in a certain peak value. This first circuit branch contains a first counter for counting output values of the comparator and a first comparison device which is operatively connected with a first constant-value transmitter. A constant which is inputted to the constant-value transmitter and corresponding to the grain size of a non-worn rough grinding wheel is compared with the counterstate and upon reaching a predetermined comparison result, corresponding to small grinding wheel wear and a smooth surface of the grinding wheel, this first comparison device delivers a signal at a first output terminal which governs the oompensating feed or advance of the dressing device. With this system design the counter state of the first counter corresponds to the pulse count during a feeling or scanning interval. Since the pulses, however,are produced by virtue of the irregularities in the surface of the grinding wheel, because a displacement path change of the dressing tool, typically a dressing diamond, in the order of magnitude of 1 $\mu$m already causes an appreciable change in the output signal of the displacement path transmitter, this counter state can be beneficially employed as an indication of the surface properties of the grinding wheel. For instance, the pores of the grinding wheel may become clogged, for instance due to grinding dust, oil and so forth, and hence, there are delivered fewer pulses. It is thus possible to only then dress the grinding wheel when dressing is absolutely needed, and additionally, there can be correspondingly adjusted the stroke or displacement of the dressing tool.

The control circuit advantageously contains a second circuit branch possessing an integrator between the output of the displacement path transmitter and a second output terminal connected with an axial positioning feed device for the grinding wheel. This integrator integrates the displacement path transmitter-output signals, throughout a feeler or scanner interval, into a signal whose effective value constitutes a measure for the wear of the grinding wheel. The control circuit thus delivers a wear signal, by means of which there can be exactly determined when, to what extent and how frequently it is necessary to readjust the grinding wheel in axial direction.

According to a further facet of the invention the control circuit possesses a third circuit branch between the output of the integrator and a third output terminal operatively connected with a grinding wheel-radial positioning and dressing device. In this third circuit branch there is connected in series an anologue-digital converter and a second comparison device. The second comparison device receives from a second constant-value transmitter a constant which has been preset in the second constant-value transmitter as a predetermined active rim-degree of wear. The second comparison device compares the received constant from the second constant.-value transmitter with digital values outputted by the analogue-digital converter and in the presence of certain comparison results delivers a signal to the third output terminal.

It is possible to connect with the third output terminal a series circuit arrangement of a second counter and a third comparison device having an output terminal. A third constant-value transmitter can be connected with the third comparison device. This third constant-value transmitter has a preset or presettable constant which indicates how frequently the jacket or outer surface of the grinding wheel must be dressed.

This third comparison device compares the state of the second counter with the aforesaid constant and upon identity or approximate identity of such compared values delivers a cutoff signal by means of its mentioned output terminal.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically illustrates a control circuit according to the invention;

DETAILED DESCRIPTION OF THE PREFERRED EMBODIMENTS

Figure 3:
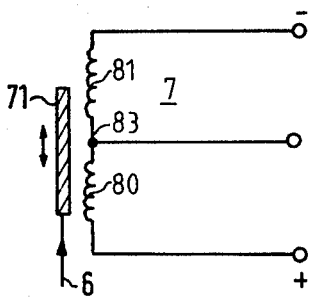
FIG. 3 illustrates in schematic circuit diagram the functional principles of an inductive displacement path transmitter or pick-up.

Describing now the drawings, and turning attention specifically to FIG. 1 there is schematically illustrated therein a control circuit for an apparatus for the compensating feed or adjustment and dressing of a dished or plate-shaped grinding wheel 1. This grinding wheel 1 has only been partially shown in FIG. 1 and rotates about a vertical axis of rotation. A feeler or scanner 2 may be constructed like the feeler designated by reference character 15 in the aforementioned U.S. Pat. No. 4,213,277. This feeler 2 is pivotably mounted at a pivot location 3. At its right-hand end this feeler 2 carries a feeler or scanner diamond 4 which, upon rocking or pivoting of the feeler 2, can be brought into contact with an active rim or ring-shaped surface 1*a* of the grinding wheel 1. At the lever arm 2*b* of the feeler 2, which is located to the left of the pivot location or fulcrum 3, there is effective any suitable actuation device 5 which periodically presses the feeler diamond 4 against the grinding wheel 1, so that an operative connection 6 provided at the other end of the feeler 2 acts upon a suitable element, such as the element 71 to be described more fully hereinafter in conjunction with FIG. 3, which is located internally of a displacement path transmitter or pick-up 7. The feeler 2 is pivoted by the actuation device or actuation means 5 periodically such that the feeler diamond 4 contacts the grinding wheel 1 for a brief period of time $t_T$ and then again is lifted-off as such has been indicated by the graph of FIG. 2 In such graph the interval "feeling" or "scanning" ($t_T$) amounts to 0.3 seconds and the interval "lift-off", meaning the time when the feeler diamond 4 is not in contact with the grinding wheel 1, amounts to 0.7 seconds. Consequently, there is beneficially avoided unnecessary wear of the grinding wheel 1 by the feeler diamond 4. The short pivotal movement of the lever arm 2*a* is converted into an appreciably longer pivotal path of the lever arm 2*b* and into a corresponding translatory movement at the operative connection 6, which may be constituted by a suitable displacement element acting upon the element 71 which, in the arrangement of FIG. 3, is constituted by an iron core of an inductive pick-up.

Instead of using the feeler contact 17 disclosed in FIG. 1 of the aforementioned U.S. Pat. No. 4,213,277, with the arrangement of the present development the control circuit is equipped with a displacement path transmitter or pick-up which can be constituted by an inductive, a capacitive or an optical displacement path pick-up. Such displacement path pick-up or transmitter is capable of delivering, instead of the purely Yes/No-information of the prior art feeler contact, a continuous signal which is dependent upon the path of movement of the feeler diamond 4. The here described embodiment of control circuit will be explained, purely by way of example and not limitation, as being used in conjuntion with an inductive displacement path transmitter or pick-up. An example of such will be evident from the schematic showing of FIG. 3. A to-and-fro moveable element 71 which as explained may be constituted by an iron core, is arranged in or adjacent to two series connected coils 80 and 81. As is well known, the position of such displaceable element 71 influences the magnetic field of the coils 80 and 81, thus, the output signal of the displacement path transmitter or transducer. This output signal can be tapped-off at the terminal or connection point 83 of both of the coils 80 and 81 and the other terminal of the one or other coil 80, 81, whereas the supply voltage of the displacement path transmitter 7 is delivered to the terminals designated with a "+" sign and a "−" sign in FIG. 3. The position of the iron core 71 by virtue of the operative connection 6, which in the exemplary described embodiment can be constituted by a suitable mechanical connection as explained, is dependent upon the position of the feeler diamond 4 or equivalent structure. Irregularities in the grinding disc 1 in the order of magnitude 1 μm cause the feeler diamond 4 and thus the displacement path transmitter 7 to already respond.

Figure 2:
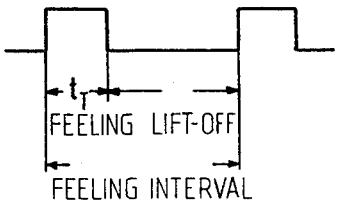
FIG. 2 is a diagram schematically illustrating a feeler or scanner interval.
Figure 4:
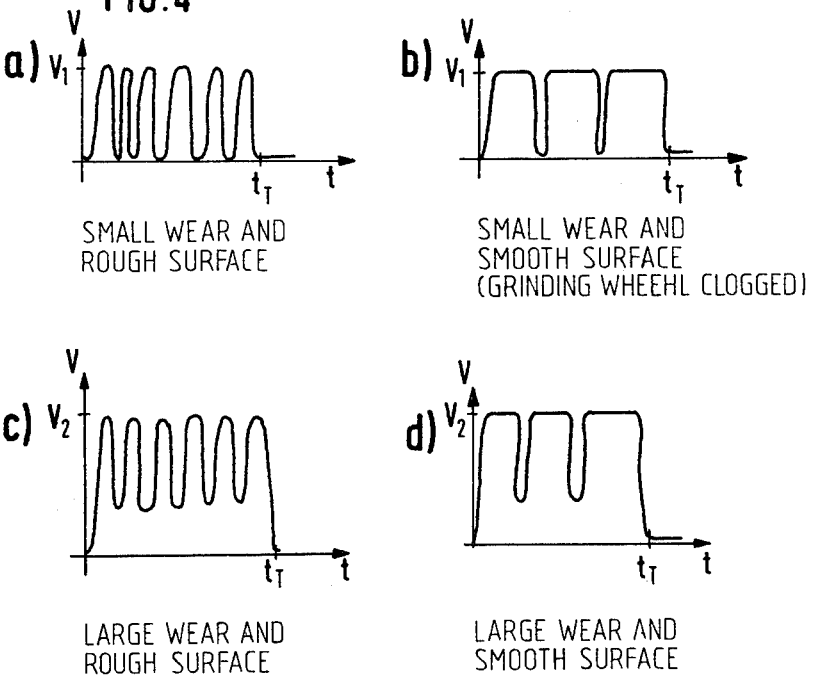
FIGS. 4*a*, 4*b*, 4*c* and 4*d* respectively illustrate the shape or form of output signals of the displacement path transmitter.

At the feeler interval $t_T$ shown in FIG. 2, where the feeler diamond 4 contacts the grinding wheel or disc 1, the displacement path transmitter 7 delivers an output signal having a signal shape as indicated in FIGS. 4*a*, 4*b*, 4*c* and 4*d*. FIG. 4*a* shows a voltage signal, the shape of which corresponds to the oscillations of the feeler diamond 4. This oscillatory motion of the feeler diamond 4 is accomplished when the latter follows the surface of the grinding wheel 1 and is deflected by grains of the grinding wheel or generally by irregularities in the grinding wheel surface. This signal is representative of small wear of the grinding wheel 1 and a rough, i.e. open-pore grinding wheel surface. The signal shown in FIG. 4*b* corresponds to small wear of the grinding wheel 1 and a smooth surface, wherein the pores of the grinding wheel are clogged, for instance, by grinding dust and oil. Each peak of the signal is wider as a function of time, as shown in FIG. 4*b*, since the feeler diamond 4 is deflected much more seldomly by a grinding wheel grain protruding out of the surface of the grinding wheel 1. The signal shown in FIG. 4*c* corresponds to a large wear of the grinding wheel 1 and a rough grinding wheel surface. By virtue of the larger wear of the grinding wheel 1 in this case, in relation to the situation represented by FIG. 4*a*, the feeler diamond 4 must cover a larger path, so that the iron core 71 in the displacement path transmitter 7 is shifted upwardly through a correspondingly larger path. At the region of this upper position the feeler diamond 4 and the iron core 71 then perform the same oscillations as was the case represented by FIG. 4*a*. As a result of the foregoing the signal illustrated in FIG. 4*c* possesses a greater effective value than the signal shown in FIG. 4*a*. The signal illustrated in FIG. 4*d* corresponds to a large wear of the grinding wheel 1 and a smooth grinding wheel surface. From the previously explained reasons it will be evident that the signal shown in FIG. 4*d* possesses a greater effective value than the signal of FIG. 4*b*.

Reverting again to the circuit shown in FIG. 1 it will be recognized that connected in circuit following the displacement path transmitter or pick-up 4 are three circuit branches I, II and III, which now will be described individually and in detail.

At the circuit branch I the output 7*a* of the displacement path transmitter 7 is connected with a comparator 8, the output 8*a* of which is connected with the input 9*a* of a counter 9. The output 9*b* of the counter 9 is connected with the input 1O*a* of a comparator or comparison device 10. The second input 1O*b* of the comparison device 10 is connected with a constant-value transmitter 11. The output 1O*c* of the comparison device 10 is connected with a terminal $A_I$. The set input S and the reset input R of the counter 9 are operatively connected with the actuation device or actuation means 5.

This circuit branch I evaluates output signals of the displacement path transmitter 7 of the type illustrated in FIGS. 4*a* and 4*b* in the following manner:

The comparator 8, which may be a pulse shaper, is always then triggered when the ascending signal flanks or edges attain a value $V_1$, so that comparator 8 then delivers an appropriate pulse to the counter 9. The actuation device 5 contains, for instance, an asynchronous motor which drives a cam disc by means of a stepdown gearing, by means of which during each feeling or scanning interval the feeler 2 is pivoted for the scanning time $t_T$. At the start of each feeling or scanning interval the actuation device 5 delivers a release signal to the input S of the counter 9, so that this counter 9 is set and thus is capable, during the feeler time $t_T$, of counting the pulses infed by the comparator 8. At the end of the time $t_T$ the counter 9 is reset by a reset signal delivered to such counter 9 at its reset input R from the actuation device 5, and thus, there is terminated the counting operation. The counter state is delivered to the comparison device 10 which compares such counter state with a constant, i.e. a signal representative of a constant furnished by the constant-value transmitter 11. As to the constants delivered by the constant value transmitter 11 such may be a specific value for each employed grinding wheel and which is dependent upon the grains of the grinding wheel 1. The constant to be used is set at the constant-value transmitter 11 for each employed type of grinding wheel 1. This constant can be determined for each new grinding wheel by measurement and fixed with the aid of the here described circuit. The counter 9, during the feeler time $t_T$, counts the number of peaks of the signals of FIG. 4*a* or 4*b* based upon the pulses delivered to such counter 9 by the comparator 8. As an example there will be assumed the situation portrayed in FIG. 4*a* wherein there will be assumed that ten signal peaks are produced by a new grinding wheel 1, during the feeler time $t_T$. Therefore, the number "10" is set at the constant-value transmitter 11. This value "10" is compared with the pulse number or count delivered by the counter 9. When the comparison device or comparator 10 has determined that the grinding wheel constant and the counted value are the same, this means that the grinding wheel is properly functioning and does not need to be dressed. On the other hand, if the comparison device 10 has determined that the pulse count delivered by the counter 9 is somewhat smaller than the constant and, for instance, according to the assumed example of FIG. 4*a*, is equal to "6" then this means that there is present a small wear of the grinding wheel 1 and a rough grinding wheel surface. If the comparison result indicates that the pulse count of the counter 9 is appreciably smaller than the constant, then this means that there has arisen a small wear of the grinding wheel 1 and there is present a smooth grinding wheel surface (FIG. 4*b*). Since a smooth grinding wheel surface is disadvantageous, in this case there is triggered by the signal outputted at the terminal $A_I$ a dressing operation.

By means of the circuit branch I the control circuit is capable of not only triggering a dressing operation, but also determining the stroke or displacement of the dressing tool. This enables performing an appreciably more accurate dressing operation than with the heretofore known equipment, since with the prior art system dressing was accomplished at regular time intervals and always with the same stroke or displacement of the dressing tool. The latter situation is particularly undesireable when working with grinding wheels which are only used for finish grinding, i.e. possess an appreciably longer service life because of the fact that they have an appreciably lower amount of wear. The control circuit of the invention therefore affords considerably greater advantages, since it only then first initiates a dressing operation when in fact there is present a smooth, i.e. smeared or clogged grinding wheel surface. The signal delivered at the terminal $A_I$ is infed to a conventional dressing device which, as a function of the magnitude of the signal, can be infinitely adjusted. After such positional adjustment has been accomplished the dressing diamond performs a dressing operation in a manner as is known with the prior art equipment.

In the circuit branch I there is of interest only the number of signal peaks of the output signal of the displacement path transmitter 7 since this signal peak number renders possible, based upon the comparison thereof with the grinding wheel constant, drawing of a conclusion concerning the condition of the surface of the grinding wheel 1. On the other hand, in the circuit branch II there is additionally evaluated the amplitude of the signal peaks, since such have a peak value $V_2$ which is greater than the signal peak value $V_1$ when there is present a more pronounced wear of the grinding wheel 1.

To this end, it will be seen by inspecting FIG. 1 that the circuit branch II contains an integrator 12, the input 12*a* of which is connected with the output 7*a* of the displacement path transmitter 7 and the integrator output 12*b* of which is connected with an output terminal $A_{II}$. Throughout the feeler time $t_T$ the integrator 12 integrates the output signal of the displacement path transmitter and delivers, as an integration result, a wear signal to the output terminal $A_{II}$. The voltage effective value of this output signal constitutes a direct indication as to the intensity of the wear which has occurred at the grinding wheel 1 and the extent to which there must be adjusted or accomplished the compensating feed of the grinding wheel spindle. The wear signal delivered to the output terminal $A_{II}$ is infed to a conventional infinitely variable adjustment drive for the grinding wheel spindle.

In the case of gear grinding machines there frequently exists the possibility of manually positionally readjusting the grinding wheel. It can happen when performing such manual adjustment work that the grinding wheel is readjusted through too great a distance. In such case the circuit branch II enables detecting such too great readjustment of the grinding wheel, because the iron core 71 of the inductive displacement path transmitter 7 will be moved to a greater extent out of the magnetic field and then the voltage effective value formed by the integrator 12 will be appreciably smaller than the case where there is present a rough grinding wheel surface for a correct grinding wheel positioning. The grinding wheel, in this case, automatically can be reset back to the proper position.

Continuing, and turning attention now to the circuit branch III the same will be seen to contain an analogue-digital converter 13, the input 13*a* of which is connected in circuit with the output 12*b* of the integrator 12 and the converter output 13*b* of which is connected with the input 14*a* of a comparator or comparison device 14. The analogue-digital converter 13 delivers, in accordance with the voltage delivered by the integrator 12, a number of digital values, i.e. digital signals, which are then compared with a constant by the comparison device 14. This constant i.e. the signal representative of such constant, is inputted to the comparison device 14 by means of a further input 14*b* of such comparison device 14 which is connected with a constant-value transmitter 15. The comparison device or comparator 14 delivers the comparison result, in the form of an output signal, to a terminal $A_{III}$.

Figure 5:
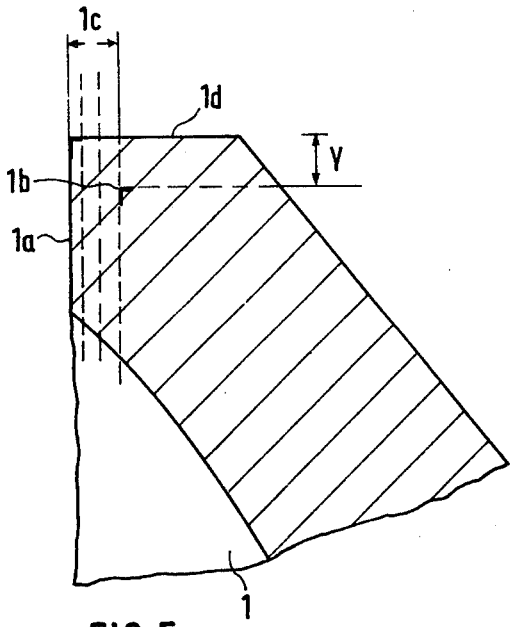
FIG. 5 is a fragmentary sectional view of a grinding wheel.

The constant which is to be inputted into the constant-value transmitter 15 for each new grinding wheel is determined in the following manner:

In FIG. 5 the vertically indicated broken lines represent wear of the grinding wheel which, in each case, demand a readjustment or repositioning of the grinding wheel because the grinding wheel, due to the wear it has experienced and the dressing which it has undergone becomes increasingly thinner, i.e. its ring-shaped surface or active rim 1*a* moves increasingly towards the right of the showing of FIG. 5. When there is present a certain amount of grinding wheel wear the grinding wheel, measured at its jacket surface 1*d*, has become so thin that, for instance during grinding large gear teeth, there exists the danger that the grinding wheel during the grinding operation will be displaced away by the ground workpiece or gear. It is therefore necessary that after a certain number of compensating feeds or readjustments of the grinding wheel 1 the jacket or outer surface 1*d* thereof be machined. This machining resides in dressing the jacket surface 1*d* by means of a dressing diamond through the dimension Y. The constant for the constant-value transmitter 15 therefore can be determined such that, for instance, following 15 μm compensating feeds (wear degree amounting to the dimension 1*c*) it is necessary to dress the jacket or outer surface 1*d* of the grinding wheel once by the amount Y so that the grinding wheel again has imparted thereto at its grinding point 1*b* its original strength. The amount of wear 1*c* is therefore inputted into the constant-value transmitter 15. Since the original thickness of the grinding wheel is known, it is possible to determine with the aid of the signal delivered at the terminal $A_{III}$ the extent to which the grinding wheel has already been worn at the active rim or ring-shaped surface l*a* and then to undertake the dressing by the value or amount Y. The comparison device or comparator 14 compares the constant delivered by the constant-value transmitter 15 with the value received from the analogue-digital converter 13 and, when the result exceeds a predetermined value, the grinding wheel is dressed as its jacket surface by the amount Y. For this purpose the grinding spindle together with the grinding wheel is moved upwardly in the showing of FIG. 5 through the distance or amount Y in response to the signal appearing at the terminal $A_{III}$, and the dressing diamond travels over the jacket surface of the grinding wheel and dresses such by the amount Y.

At the output side of the circuit branch III there is connected a counter 16 the output 16*a* of which is connected with an input 17*a* of a comparison device or comparator 17. This comparison device 17 has a further input 17*b* which is operatively connected with a constant-value transmitter 18. The output 17*c* of the comparison device 17 is connected with a terminal $A'_{III}$. The counter 16 counts the output pulses of the comparison device 14. The counter state is compared in each instance in the comparison device 17 with the constant set at the constant-value transmitter 18. This constant indicates the amount of times that the dimension Y must be dressed until the grinding wheel no longer can be used. When the comparison device 17 has determined that the counter state of the counter 16 and the constant, i.e. the signal representative of such constant and delivered by the constant-value transmitter 18 are of the same magnitude, then by means of the signal delivered at the terminal $A'_{III}$ the grinding machine is turned-off, since the grinding wheel must now be exchanged. Additionally, the counter 16, in this case, is extinguished to "null" by means of a not particularly illustrated reset input.

Figure 6:
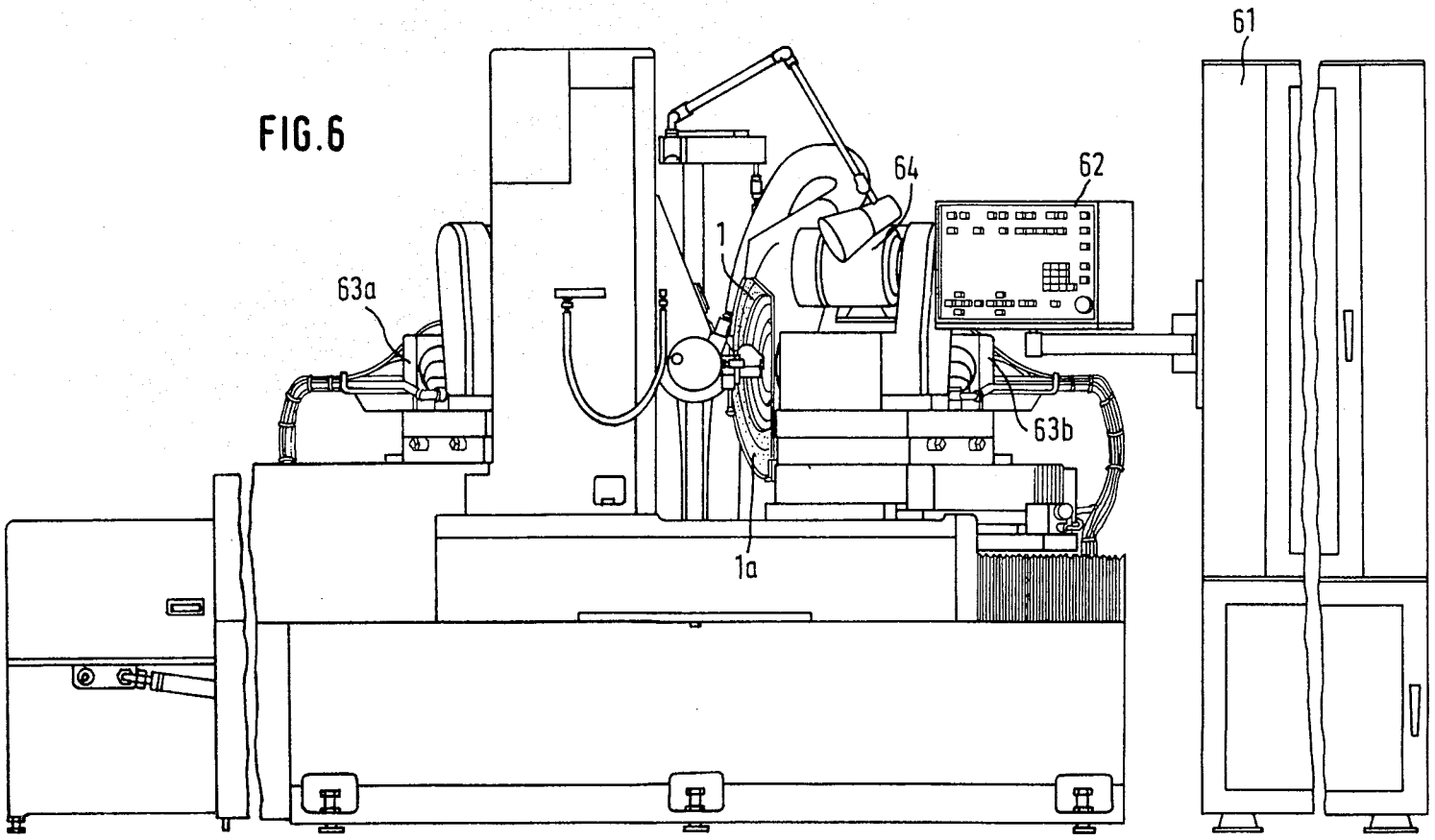
FIG. 6 is schematic illustration of a gear wheel grinding machine with which there can be employed the control circuit of the present development.

Finally, in FIG. 6 there has been shown a view of a gear grinding machine with which there can be employed the control circuit of the present development and described above. This control circuit is accomodated in an electronic cabinet 61 arranged adjacent the gear grinding machine. An operating console or panel 62 carries the setting devices for the constant-value transmitters 11, 15 and 18. Reference characters 63*a* and 63*b* designate the feed cylinder for both of the grinding wheels of the machine, whereas reference character 64 designates a drive motor for one of both feed carriages or slides for the axial compensating feed adjustment of the grinding wheel spindle.

While there are shown and described present preferred embodiments of the invention, it is to be distinctly understood that the invention is not limited thereto, but may be otherwise variously embodied and practiced within the scope of the following claims. Accordingly,

What I claim is:

1. A control circuit for an apparatus for adjusting and dressing a grinding wheel, comprising:

a feeler having a first end which can be periodically brought into contact with a grinding wheel;

said feeler being arranged to move in response to surface roughness of the grinding wheel while said first end is in contact therewith;

said feeler having a second end;

means for operatively connecting the second end of the feeler with the control circuit;

a displacement path transmitter upon which the opposite end of said feeler acts by means of said operatively connecting means;

said displacement path transmitter having an output for delivering thereat putput singals proportional to the feeler movements due to the condition of the grinding wheel in order to initiate, whenever necessary, a dressing operation;

at least one circuit branch for evaluating and processing said output signals of said displacement path transmitter in order to initiate, when necessary, a dressing operation; and said displacement path transmitter having said output connected with said at least one circuit branch for delivering said putput signals thereto.

2. The control circuit as defined in claim 1, wherein:

said displacement path transmitter comprises a capacitive displacement path transmitter and delivers pulsating signals in accordance with the movement of the feeler caused by irregularities in the grinding wheel.

3. The control circuit as defined in claim 1, wherein:

said displacement path transmitter comprises an inductive displacement path transmitter which delivers pulsating signals in accordance with the movements of the feeler caused by irregularities in the grinding wheel.

4. The control circuit as defined in claim 1, wherein:

said displacement path transmitter comprises a photoelectric displacement path transmitter which delivers pulsating signals in accordance with the movements of the feeler caused by irregularities in the grinding wheel.

5. The control circuit as defined in claim 1, wherein:

said at least one circuit branch defines a first circuit branch provided with a first output terminal operatively associated with a dressing device for dressing an active rim of the grinding wheel;

a comparator provided for the first circuit branch;

each of said output signals delivered by said displacement path transmitter has a signal edge;

said comparator forming a digital value from each signal edge of the output signals of the displacement path transmitter which produce a predetermined signal peak value;

said comparator being connected with the output of said displacement path transmitter;

said comparator having an output;

a first counter connected with the output of said comparator;

said first counter serving for counting the signal output of said comparator;

a first comparison device connected in series with said first counter;

a first constant-value transmitter operatively connected with said first comparison device and having settable thereat a constant representative of grains of a non-worn rough grinding wheel;

said first comparison device comparing the counter state of said first counter with a signal representative of said constant;

said first comparison sevice in the presence of a predetermined comparison result corresponding to a small grinding wheel wear and a smooth surface of the grinding wheel delivering a signal to said first output terminal; and said delivered signal at said first output terminal being capable of initiating a compensating feed of the dressing device.

6. The control circuit as defined in claim 5, further including:

an actuation device with which there is operatively connected said first counter;

said actuation device actuating said feeler and simultaneously activating said first counter; and said actuation device extinguishing a count in said first counter after expiration of a predetermined feeler interval.

7. The control circuit as defined in claim 5, further including:

a second circuit branch provided with a second output terminal connected with an axial compensating feed device for the grinding wheel;

an integrator provided for said second circuit branch between the output of said displacement path transmitter and said second output terminal and connected parallel to said first counter; and said integrator integrating the output signals of the displacement path transmitter during a predetermined period of time so as to form an effective value of said output signals as a measure for the wear of the grinding wheel.

8. The control circuit as defined in claim 3, further including:

a second circuit branch provided with an output terminal connected with an axial compensating feed device for the grinding wheel;

an integrator provided for said second circuit branch between the output of said displacement path transmitter and said output terminal; and said integrator integrating the output signals of the displacement path transmitter during a predetermined period of time so as to form an effective value of said putput signals as a measure for the wear of the grinding wheel.

9. The control circuit as defined in claim 7, further including:

a third circuit branch having a third output terminal connected with a grinding wheel radial adjustment and dressing device:

said integrator being provided with an output;

said third circuit branch being connected between said output of said integrator and said third output terminal;

said third circuit branch containing a series circuit of an analogue-digital converter and a second comparison device;

a second constant-value transmitter for delivering to said second comparison device a preset signal representative of a preset constant and constituting a predetermined degree of wear of the active rim of said grinding wheel;

said second comparison device comparing said signal representative of said preset constant with digital signals delivered by said analogue-digital converter; and said second comparison device delivering a signal to said third output terminal when said second comparison device determines a predetermined comparison result.

10. The control circuit as defined in claim 9, further including:

a series circuit of a second counter and a third comparison device connected in circuit with said third output terminal;

said third comparison device having an output terminal;

a third constant-value transmitter operatively connected with said third comparison device;

said third constant-value transmitter delivering a preset signal representative of a preset constant to said third constant-value transmitter;

said preset constant signal indicating the frequency with which a jacket surface of the grinding disc must be dressed;

said third comparison device comparing said constant signal with a counter state of said second counter; and upon substantial identity of the constant signal and the counter state of the second counter said third comparison device delivering a cutoff signal at its output terminal.

11. A control circuit for an apparatus for adjusting and dressing a grinding wheel, comprising:

a feeler having a first end which can be periodically brought into contact with a grinding wheel for a predetermined period of time;

said feeler being arranged to move in response to surface roughness of the grinding wheel while said first end is in contact therewith during said predetermined period of time;

said feeler having a second end;

means for operatively connecting the second end of the feeler with the control circuit;

a displacement path transmitter upon which the opposite end of said feeler acts by means of said operatively connecting means;

said displacement path transmitter having an output for delivering thereat putput signals proportional to the feeler movements due to the condition of the grinding wheel in order to initiate, whenever necessary, a dressing operation;

at least one circuit branch for evaluating and processing said output signals of said displacement path transmitter in order to initiate, when necessary, a dressing operation;

said at least one circuit branch defines a first circuit branch provided with a first output terminal operatively associated with a dressing device for dressing an active rim of the grinding wheel;

a comparator provided for the first circuit branch;

each of said output signals delivered by said displacement path transmitter has a signal edge;

said comparator forming a digital value from each signal flank edge of the output signals of the displacement path transmitter which produce a predetermined signal peak value;

said comparator being connected with the output of said displacement path transmitter;

said comparator having an output;

a first counter connected with the output of said comparator;

said first counter serving for counting the signal output of said comparator;

a first comparison device connected in series with said first counter;

a first constant-value transmitter operatively connected with said first comparison device and having settable thereat a constant representative of grains of a non-worn rough grinding wheel;

said first comparison device comparing the counter state of said first counter with signal representative of said constant;

said first comparison device in the presence of a predetermined comparison result corresponding to a small grinding wheel wear and a smooth surface of the grinding wheel delivering a signal to said first output terminal; and said delivered signal at said first output terminal being capable of initiating a compensating feed of the dressing device.

12. A control circuit for an apparatus for adjusting and dressing a grinding wheel, comprising:

a feeler having a feeler tip and arranged to move in response to surface roughness and wear of the grinding wheel;

a displacement path transmitter having an output and being operatively connected to said feeler tip;

said displacement path transmitter generating, at said output thereof, electrical signals which are proportional to the movements of said feeler;

first circuit connected to said output of said displacement path transmitter and having a first output terminal operatively connected to a dressing device for dressing the grinding wheel;

said first circuit comprising a first comparator delivering an output signal each time said electrical signal generated by said displacement path transmitter exceeds a predetermined value, a counter connected in series with said first comparator, a constant value transmitter, and a second comparator connected in series with to said counter and connected to said constant value transmitter and to said first output terminal;

a second circuit connected to said output of said displacement path transmitter and having a second output terminal operatively connected to an axial compensating feed device for the grinding wheel; and said second circuit comprising an integrator integrating said electrical signals from said displacement path transmitter for a predetermined period of time in order to generate an effective value of said electrical signals.

* * * * *